United States Patent [19]

Guardia

[11] Patent Number: 4,763,933

[45] Date of Patent: Aug. 16, 1988

[54] LATCHING ARRANGEMENT

[75] Inventor: James F. Guardia, Yorba Linda, Calif.

[73] Assignee: A-l Aluminum Products, Inc., Gardena, Calif.

[21] Appl. No.: 31,926

[22] Filed: Mar. 30, 1987

[51] Int. Cl.[4] ..... E05C 19/06

[52] U.S. Cl. ..... 292/13; 292/54; 292/228; 292/213; 292/DIG. 46

[58] Field of Search ..... 292/54, 13, DIG. 46, 292/219, 228, 44, 213, 304, DIG. 44, 210

[56] References Cited

U.S. PATENT DOCUMENTS

| | | | |
|---|---|---|---|
| 715,217 | 12/1902 | Sieffert | 292/228 |
| 906,452 | 12/1908 | McCleer | 292/DIG. 46 X |
| 2,707,121 | 4/1955 | Behnke | 292/228 |
| 3,078,524 | 2/1963 | Minick | 292/228 |
| 3,161,923 | 12/1964 | Crain | 292/DIG. 46 X |
| 3,884,514 | 5/1975 | Praska | 292/DIG. 46 X |
| 4,106,239 | 8/1978 | Bancroft et al. | 292/DIG. 46 X |
| 4,253,688 | 3/1981 | Hosooka | 292/DIG. 46 X |

FOREIGN PATENT DOCUMENTS

| | | | |
|---|---|---|---|
| 802046 | 7/1949 | Fed. Rep. of Germany | 292/DIG. 43 X |
| 3227804 | 2/1984 | Fed. Rep. of Germany | 292/216 |
| 2069586 | 8/1981 | United Kingdom | 292/336.3 X |

*Primary Examiner*—Gary L. Smith
*Assistant Examiner*—Curtis B. Brueske
*Attorney, Agent, or Firm*—Don B. Finkelstein

[57] ABSTRACT

An improved latching arrangement for selectively latching two members together to prevent relative movement there between in first directions. The two members may, for example, be the fixed and sliding windows of a sliding window. The improved latch means of the latching arrangement of the present invention is pivotally mounted on the moving member and is resiliently biased towards the fixed member. The latch means has a lip means that is engagable with a shoulder means on the fixed member when the latch means is in the latched position. The latch means is pivotally moveable away from the fixed member so that the lip clears the shoulder to allow relative movement of the sliding member with respect to the fixed member. The latch means is also provided with a swivel cam extending outwardly from the latch means into a channel in the second member in a locking condition thereof. The swivel cam may be rotated out of the channel to an unlocked condition and in the unlocked condition the swivel cam is positioned within the latch. Relative movement between the fixed member and moving member for the unlocked condition is controlled by the pivotal position of the latch means.

16 Claims, 5 Drawing Sheets

FIG. 6
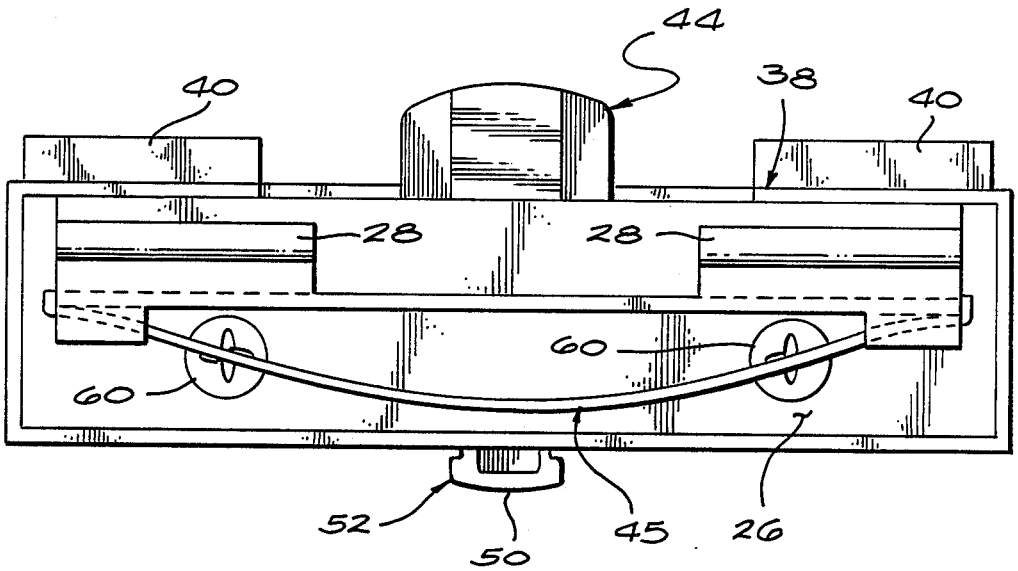
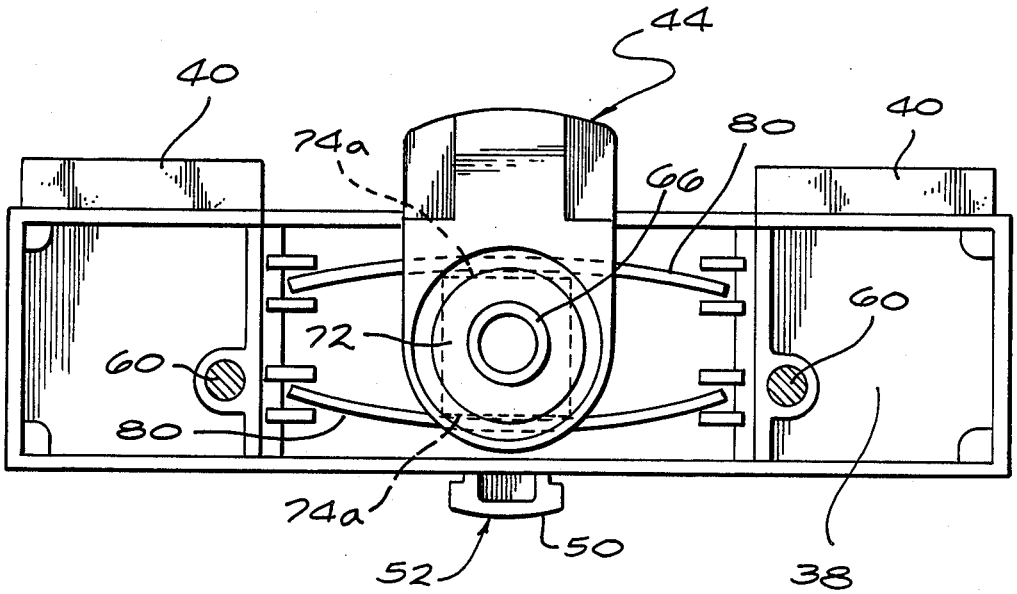
FIG. 7

LATCHING ARRANGEMENT

BACKGROUND OF THE INVENTION

1. Field of the Invention

This invention relates to the latching art and more specifically to an improved latching arrangement providing both a resiliently biased pivotal latching and a manually operatable swivel cam lock for selectively latching a first member to a second member to prevent relative movement between in the latched and locking condition thereof as well as a latched and unlocked condition, and allowing relative movement in an unlatched position and unlocked condition.

2. Description of the Prior Art

In many applications it is desirable to provide a selective securing means for selectively locking one member to another member to prevent relative movement therebetween and unlocking the first member from the second member to allow deired relative movement there between. One such application is in sliding windows. Such sliding windows are generally provided with a fixed window and a moveable window adjacent thereto. The moveable window slides in first directions relative to the fixed window to provide an open window condition and a closed window condition. When the window is closed it is often desired to lock the moveable window to the fixed window in order to prevent intruders from opening the window and entering the premises in which the window is provided.

One latching arrangement heretofor utilized in such sliding windows has been a pivotal latch generally mounted on the moveable window and resiliently biased towards the fixed window. A lip means on the latch is positioned to engage a shoulder on the fixed window to provide a latching between the fixed and moveable windows. In such prior art embodiments, in general, there is a small, limited amount of relative movement of the sliding window with respect to the fixed window since clearance between the lip on the latch and the shoulder on the fixed window must be provided to allow the latch to pivot away from the fixed window so that the lip clears the shoulder to allow the relative movement of the moveable window with respect to the fixed movement window. Such spring loaded latch means has provided a very convenient and comparatively inexpensive arrangement for automatically latching a first member to a second member such as the above described sliding windows to prevent relative movement therebetween in the latched condition.

However, in other applications in the prior art, for example sliding windows, there has been provided a more positive locking arrangement in which there is included a mannually operable swivel cam. The swivel cam in such prior art applications is generally mounted in a fixed position on the moveable window and the swivel cam swivels manually into a locking condition in which it is positioned in a channel provided in the fixed window when the swivel cam is in the locking condition. The swivel cam is rotatable from the locking condition to an unlocked condition in which the swivel cam is rotated so that it is moved out of the channel in the fixed member and thus allows the relative movement of the moveable window with respect to the fixed window in the unlocked condition. Such swivel cam locking arrangements in sliding windows generally provide a more secure lock than the above described pivotal latching arrangement. However, since the cam lock required manual operation, if it were to be left unlocked, there would be no locking whatsoever of the window. Additionally, the prior art cam locks were fixed and not moveable in second directions perpendicular to the first direction thereby limiting adjustability for locking.

However, it has been found that often it is preferred to provide in a single latch arrangement both the convenience of a pivoting latch and the security of a swivel cam lock. However, there has not heretofor been provided in, for example, sliding windows a structural arrangement that is economical to fabricate and yet provides both the convenience of the pivot latch and the security of a swivel cam lock in a single structural unit.

SUMMARY OF THE INVENTION

Accordingly, it is an object of the present invention to provide an improved latch arrangement.

It is another object of the present invention to provide an improved latch arrangement that has both pivotal latching and swivel cam locking capabilities.

It is yet another object of the present invention to provide an improved latch arrangement particularly adapted for selectively latching a first member to a second member to prevent relative movement therebetween and having both pivotal latching and rotatable swivel cam locking.

It is another object of the present invention to provide an improved latch arrangement for sliding windows that provides the convenience of a pivotal latch as well as the security of a rotary swivel cam lock.

It is a still further object of the present invention to provide an improved latch arrangement particularly adapted for latching sliding windows and providing both a pivotal latch and a rotary swivel cam lock and that is economical to fabricate and install and easy to utilize.

It will be appreciated that the embodiments of the present invention are described herein as employed in a sliding window in which the sliding window is of the type comprising a pair of members. One of the window members is fixed and the other window member is moveable in first directions relative thereto between open and closed positions. In the closed position it is desirable to provide the latching and locking arrangements of the present invention. The sliding windows heretofor utilized are of a comparatively well known design and structure. The fixed window generally is provided with a frame mullion on the external edge thereof. The moveable window is generally provided with a vent interlocker on the edte thereof that is adjacent to the frame mullion of the fixed window when the window is in the closed condition.

The latch arrangements of the present invention has a latch means pivotally mounted on the vent interlocker of the moveable window and, for the window in the closed condition, it is positioned adjacent to the frame mullion of the fixed window. Thus, the vent interlocker provides the preselected portion of the first member which is the moveable window and the frame mullion provides the preselected portion of the second member which is the fixed window.

The invention herein may, of course, be utilized in many other structural arrangements other than sliding windows and the description of the invention herein as mounted on a sliding window is for purposes of illustration only.

The latch means is generally provided with a base means pivotally mounted on the preselected portion of the first member. The first member is provided with walls defining a tubular cavity extending in a second direction substantially perpendicular to the first direction of relative movement between the first member and the second member. The base means of the latch means has a cylindrical portion that is mounted in the tubular channel of the preselected portion of the first member for both limited pivotal movement towards and away from the second member as well as linear reciprocating movement in the second direction. The linear reciprocating movement, of course, allows positioning of the latch means at any desired location along the vertical extent of the sliding window.

In addition to being slideably moveable in the second direction on the first member, the latch arrangement is also pivotably moveable on the first member towards and away from the second member. A first resilient means biases the latch arrangement towards the second member and yieldingly resists motion thereof away from the second member. The latch arrangement has a lip extending therefrom a first preselected distance towards the second member and the second member is provided with a shoulder for selectively engaging the lip for the condition of the latch arrangement in a latched position thereof. The latched position is defined as that when the first resilient means biases the latch arrangement towards the second member and the engagement of the lip means with the shoulder means prevents relative movement. The first member is provided with tab means to limit the pivotal motion of the latch means towards and away from the second member.

The latch means also comprises a locking structure and the locking structure has a swivel cam mounted on the latching means for rotary motion between a locking condition and an unlocked condition. In the locking condition the swivel cam extends a second preselected distance towards the second member and in the unlocked condition the swivel cam is rotated out of engagement with the second member. The swivel cam may be so rotated for the latching means in both the latched condition and the unlatched condition. The second preselected distance is generally greater than the first preselected distance.

The second member has walls defining a channel for receiving the swivel cam when the swivel cam is in the locking condition thereof.

Thus, the latching arrangement of the present invention provides both the convenience of the swivel latch as well as the security of a positive cam locking arrangement.

BRIEF DESCRIPTION OF THE DRAWINGS

The above embodiment of the present invention may be more fully understood from the following detailed description taken together with the accompanying drawings wherein similar reference characters refer to similar elements throughout and in which:

FIG. 6 is a view along the view line 6—6 of FIG. 5;

FIG. 7 is a view along the view line 7—7 of FIG. 5;

DESCRIPTION OF THE PREFERRED EMBODIMENTS

It will be appreciated, as noted above, that the preferred embodiment of the invention as described herein is illustrated as utilized on sliding windows in which one window is fixed and the other window is moveable and moves in first directions relative to the second window. However, such utilization of the invention herein is for illustrative purposes only and is not limiting to the applicability of the invention to other structural arrangements.

Figure 1:
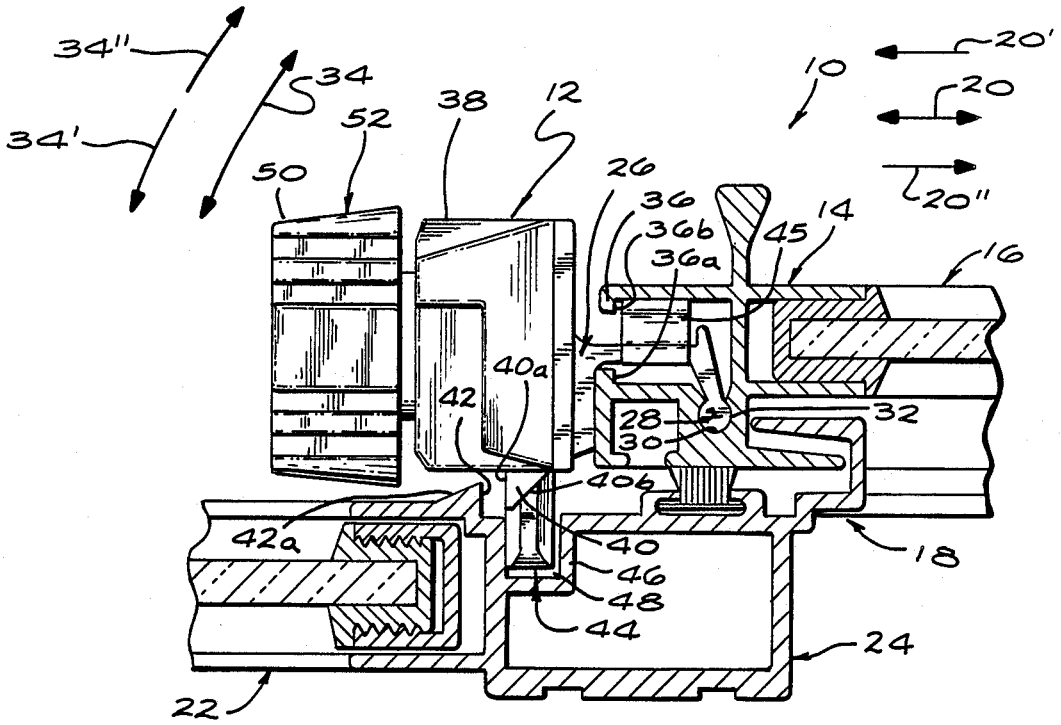
FIG. 1 is a partial sectional view of a preferred embodiment of the present invention showing the latch means thereof in a latched position and locking condition.
Figure 2:
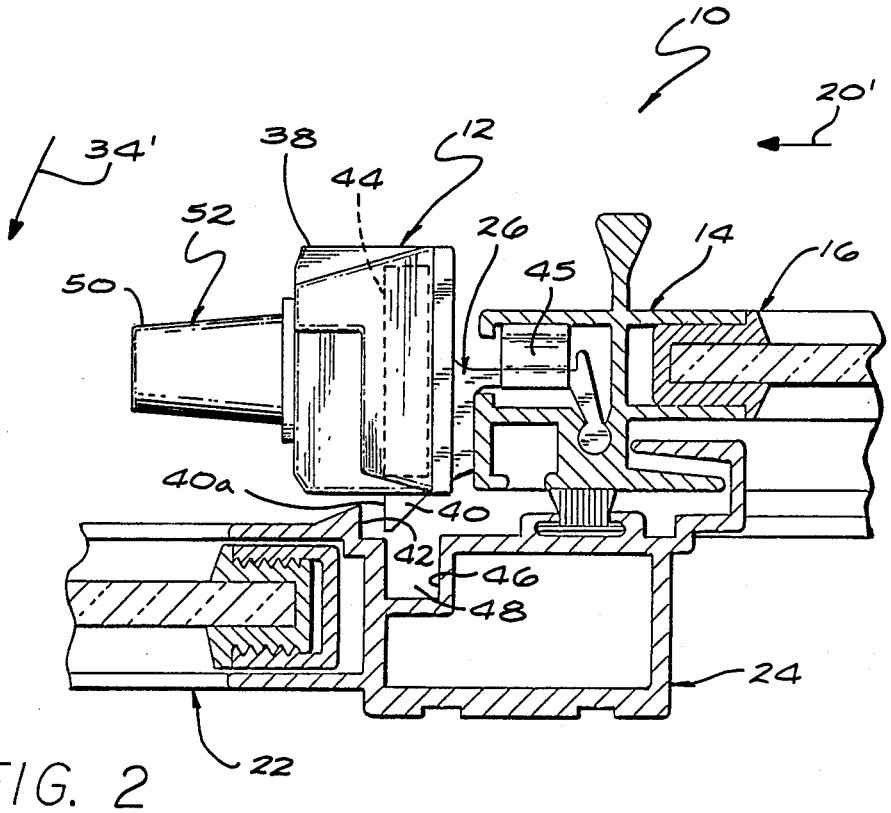
FIG. 2 illustrates the embodiment shown in FIG. 1 in a latched position and unlocked condition.
Figure 3:
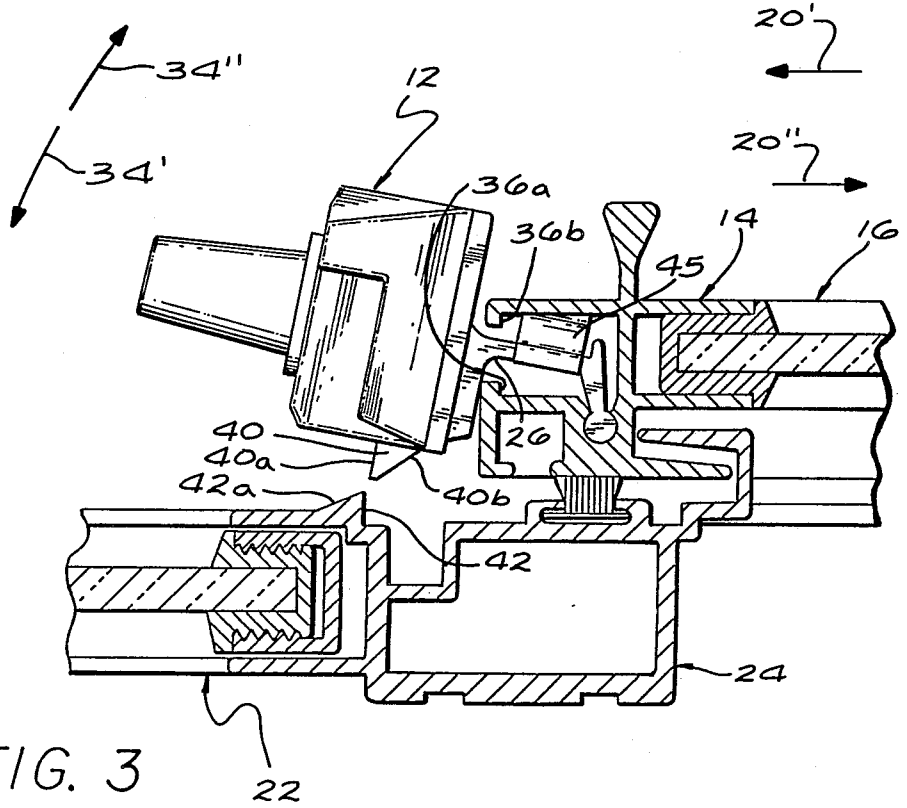
FIG. 3 illustrates the embodiment of FIG. 1 in an unlatched position and unlocked condition.

Referring now to the drawings there is illustrated in FIG. 1 an embodiment generally designated 10 of the present invention. As shown, the embodiment 10 includes a latch means 12 mounted on a preselected portion 14 of a first or moveable window 16 in a sliding window generally designated 18. The first window 16 comprises the first member and is adapted to move in the directions indicated by the arrow 20 relative to a second or fixed window 22 which comprises the second member. The second fixed window 22 of the sliding window 18 has a first preselected portion 24 that, for the closed position of the sliding window 18 as illustrated in FIGS. 1, 2 and 3, is adjacent the preselected portion 14 of the first window 16. In general, the preselected portion 24 of the second window 22 and the preselected portion 14 of the first window 16 are extrusions such as aluminum extrusions in preselected configurations.

The preselected portion 24 of the second window 22 is generally termed a frame mullion and the preselected portion 14 of the first window 16 is generally termed a vent interlocker. The second window 22 is generally fixed in the structure (not shown) in which the sliding window 18 is mounted.

The latch means 12 has a base means 26 and the base means 26 has a cylindrical portion 28 slidingly and pivotally mounted in a generally tubular cavity 30 defined by first walls 32 in the preselected portion 14 of the first window 16. The pivotal motion of the latch means 12 is towards and away from the second member or second window 22, as indicated by the arrow 34. The preselected portion 14 of the first window or first member 16 is provided with tab means generally designated 36 for limiting the pivotal movement of the latch means 12 in the directions indicated by the arrow 34 towards the second member 22 as indicated at **36*a* and away from the second member 22 as indicated at 36*b***.

The latch means 12 is also provided with a housing means generally designated 38 mounted on the base means 26 for movement therewith in the direction indicated by the arrow 34 as well as linear movement therewith. The mounting of the latch means 12 on the preselected portion 14 of the first member 16 by the cylindrical portion 28 mounted in the tubular cavity 30 allows movement of the entire latch means including the base means 26 and housing means 38 in second directions perpendicular to the first directions 20 and the second directions for the arrangement illustrated in FIG. 1 are into and out of the plane of the paper. This would correspond to movement, for a vertically mounted sliding window 18, in vertical directions up and down along the extent of the sliding window 18.

The housing 38 has a lip means generally indicated at 40 that extends from the housing means 30 towards the second member 22. The preselected portion 24 of the second member 22 has a shoulder means 42 engageable with the face 40*a* of the lip means 40 to prevent movement of the first member 16 in the direction indicated by the arrow 20'. As noted above, FIG. 1 illustrates the embodiment of 10 in the latched position as well as a locked condition. Thus a latched position of the latch means 12 corresponds to the position shown in FIG. 1 where the surface 40*a* of the lip mans 40 is in opposed relationship to the shoulder 42 of the preselected portion 24 of the second member 22 to prevent movement in a direction indicated by the arrow 20'. A first resilient means generally designated as 45 resiliently biases the latch means 12 towards the second member 22 in the direction indicated by the arrow 34' and yieldingly resists pivotal motion of the latch means 12 away from the second member 22 in the direction as indicated by the arrow 34".

The lip means 40 extends a first predetermined distance from the housing 38 towards the second member 22 to insure that, in the latched position, the surface 40*a* of the lip means 40 is opposite the shoulder 42. As shown on FIG. 1 there is a predetermined spacing between the surface 40*a* on the lip means 40 and the shoulder 42. Such spacing is required to allow clearance for the lip means 40 when it pivots in the direction indicated by the arrow 34" away from the second member 22 so that the lip means 40 may be free of engagement with the shoulder 42.

For the condition of the casement window 18 open, that is, when the first window 16 has moved in the direction indicated by the arrow 20' so that the preselected portion 14 of the first window 16 is no longer adjacent the preselected portion 24 of the second window 22 but, instead, has moved, for the configuration shown in FIG. 1, to the left thereof, and it is desired to close the window 18, the first window 16 may be moved in the direction indicated by the arrow 20" and the slanting surface 40*b* of the lip means 40 ultimately will engage the slanting surface 42*a* of the shoulder 42 causing the latch means 12 to pivot in the direction indicated by the arrow 34" until the lip means 40 clears the shoulder 42 and is in the position shown in FIG. 1.

A swivel cam generally designated 44 is rotatably mounted in the housing 38 and extends a second preselected distance which, in the embodiment 10, is greater than the first preselected distance, from the housing means 38 towards the second member 22. The preselected portion 24 of the second member 22 is provided with walls 46 defining a channel 48 into which the swivel cam 44 projects in the locking condition thereof as illustrated in FIG. 1. The swivel cam 44 is moveable into the locking condition by manual manipulation of the turning knob 50 of the handle means 52 which is rotatably mounted on the housing means 38, as described below in greater detail.

FIG. 2 illustrates the embodiment 10 shown in FIG. 1 for the condition of the latch means 12 in a latched position but in an unlocked condition. As shown on FIG. 2 it can be seen that the swivel cam 44 has been moved, for example by rotary motion as described below in greater detail until it is positioned within the housing means 38 and has been withdrawn from the channel 48 defined by the walls 46. Thus, the swivel cam 44 is free of engagement with the second means 22. However, the first member 16 is still prevented from movement in the direction indicated by the arrow 20' by the lip means 40 and its engagement with the shoulder 42 after movement of the comparatively small distance between the face 40*a* of the lip means 40 and the shoulder 42. The latch means 12 is still being biased in the direction indicated by the arrow 34' by the first resilient means 45.

FIG. 3 illustrates the embodiment shown in FIG. 1 with the latch means 12 in an unlatched position and unlocked condition. The latch means 12 has been pivotally moved in the direction indicated by arrow 34" against the resilient yielding force of the first resilient means 45 so that the lip means 40 is clear of the shoulder means 42 and thus free of engagement with any portion of the second member 22 to allow movement of the first member 16 in the direction indicated by the arrow 20'. It will be appreciated that the pivotal movement of the latch means 12 in the direction indicated by the arrow 34" is manual so that the movement of the first member 16 in the direction indicated by the arrow 20' may then occur. The tab member 36*b* engages the base means 26 to limit the pivotal movement in the direction of the arrow 34". When the first member 16 has moved in the direction of the arrow 20' so that the surface 40*a* is moved beyond the shoulder 42 the latch means 12 may be released and the first resilient means 45 moves the latch means 12 in the direction indicated by the arrow 34' towards the first member 22 till such pivotal motion is stopped by the tab member 36*a* engaging the base means 26. However, since the lip means 40 is free of engagement with the second member 22 movement in the direction indicated by the arrow 20' may then be accomplished. Upon return of the first member 16 in the direction indicated by the arrow 20" as noted above, the surface 40*b* of the lip means 40 engages the surface 42*a* of the shoulder 42 and the latch means 12 is forced to pivot in the direction indicated by the arrow 34" against the resiliency of the first resilient means 45 until the lip 40 has cleared the shoulder 42.

Figure 4:
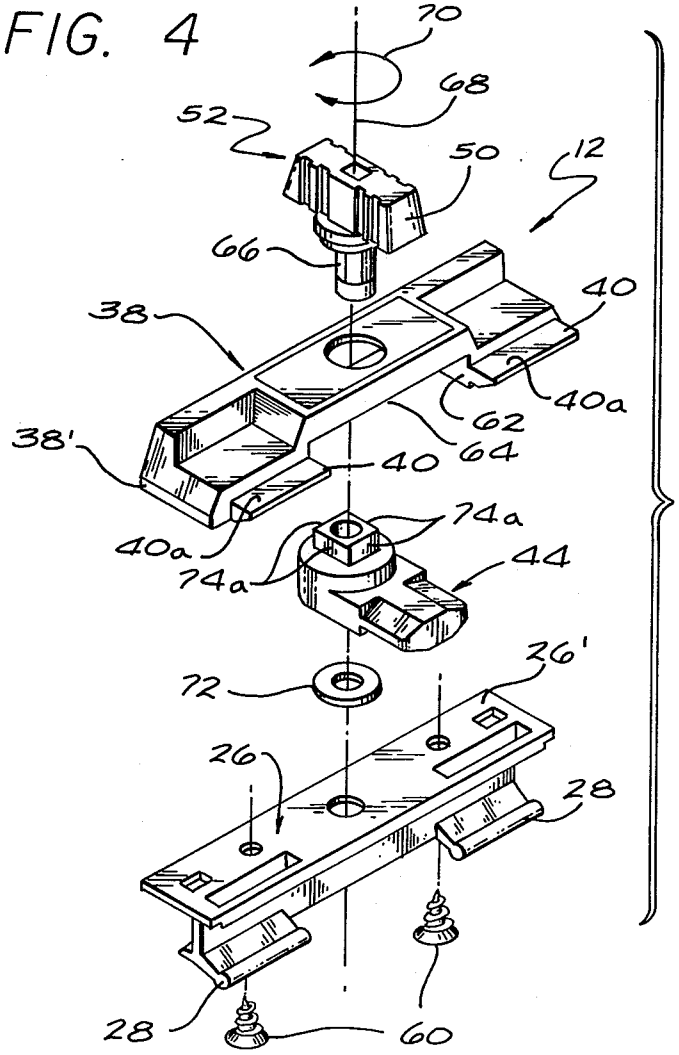
FIG. 4 is an exploded view of certain components of the embodiment described in FIG. 1.

FIG. 4 is an exploded view of the components of the improved latch means 12 of the present invention. As shown on FIG. 4 the base means 26 is coupled to the housing means 38 by a pair of, for example, screws 60. The upper surface 26' of the base means 26 is adjacent to the lower surface 38' of the housing means 38 when the screws 60 are installed to hold the assembly together. The housing means 38 has walls 62 defining a swivel cam receiving cavity 64 therebetween. Thus, the swivel cam receiving cavity 64 is defined by the walls 62 and the upper surface 26' of the base means 26. The swivel cam 44 engages a stem portion 66 of the handle 52. As can be seen from FIG. 4 the stem portion 66 extends through the housing means 38 and into the swivel cam receiving cavity 64 where it is coupled to the swivel cam 44. The coupling between the stem portion 66 of the handle 52 and the swivel cam 44 may, for example, be a press fit, a key way, a fluted surface, or any other desired configuration so that the swivel cam 44 rotates about the axis 68 for rotation of the turn knob 50 in the directions indicated by the arrow 70. According to the principles of the present invention the turn knob 50 may be rotated in either a clockwise or counterclockwise direction, as shown, and thereby rotate the swivel cam 44 in a clockwise or counterclockwise direction so that, as discussed in connection with FIG. 8, in the unlocked condition the swivel cam 44 is positioned within the swivel cam receiving cavity 64 of the housing 38. A washer means 72 may be provided and attached to the stem portion 66 for aiding in retention of the swivel cam 44 on the stem portion 66 and within the swivel cam receiving cavity 64. As shown on FIG. 4, the swivel cam 44 has the plurality of planar walls 74*a* which in the embodiment 12 are configured to define a square for purposes hereinafter set forth.

Figure 5:
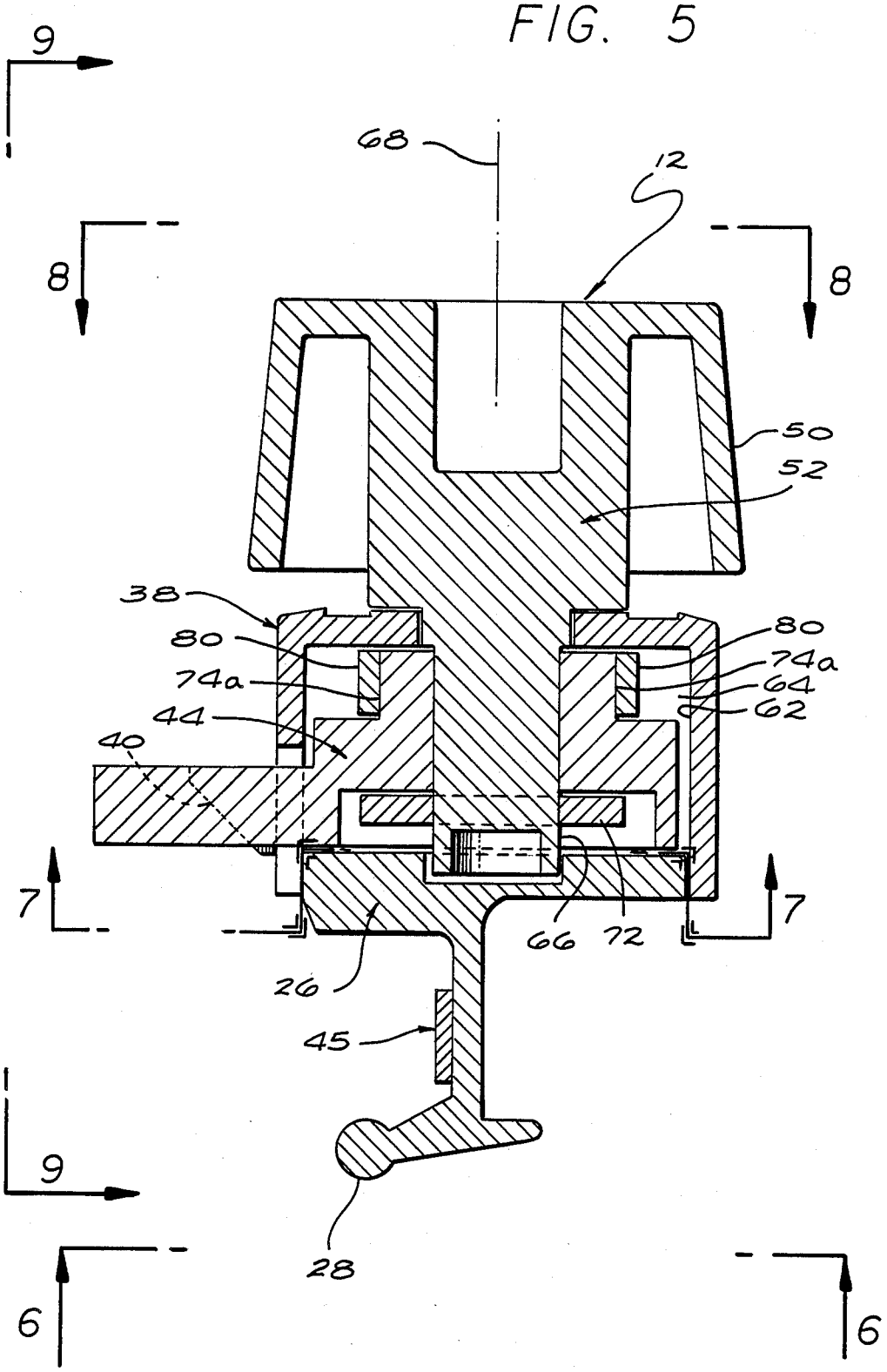
FIG. 5 is a sectional view along the line 5—5 of FIG. 9.

Referring now to FIG. 5, which is a section through the latch means 12, as can be seen the washer 72 is coupled to the stem portio 66 of the handle means of 52 within the swivel cam receiving cavity 64 of the housing 38. In the embodiment illustrated in the FIG. 5 the washer means 72 is a press fit on the stem portion 66.

As illustrated in FIG. 5 there is provided a second resilient means 80 that is mounted on the housing means 38 in the swivel cam receiving cavity 64 and bears against a first pair of the planar walls 74*a* for yieldingly resisting rotation of the handle 52 and swivel cam 44 about the axis 68. Further, because of the bearing of the second resilient means 80 against the planar walls 74*a* the swivel cam 44 is yieldingly restrained in the locking condition thereof as illustrated in FIG. 5 and in the unlocked condition.

As can be seen, the first resilient means 45 and the second resilient means 80 are preferably flat leaf springs for utilization in the particular configuration of the embodiment 12.

Figure 8:
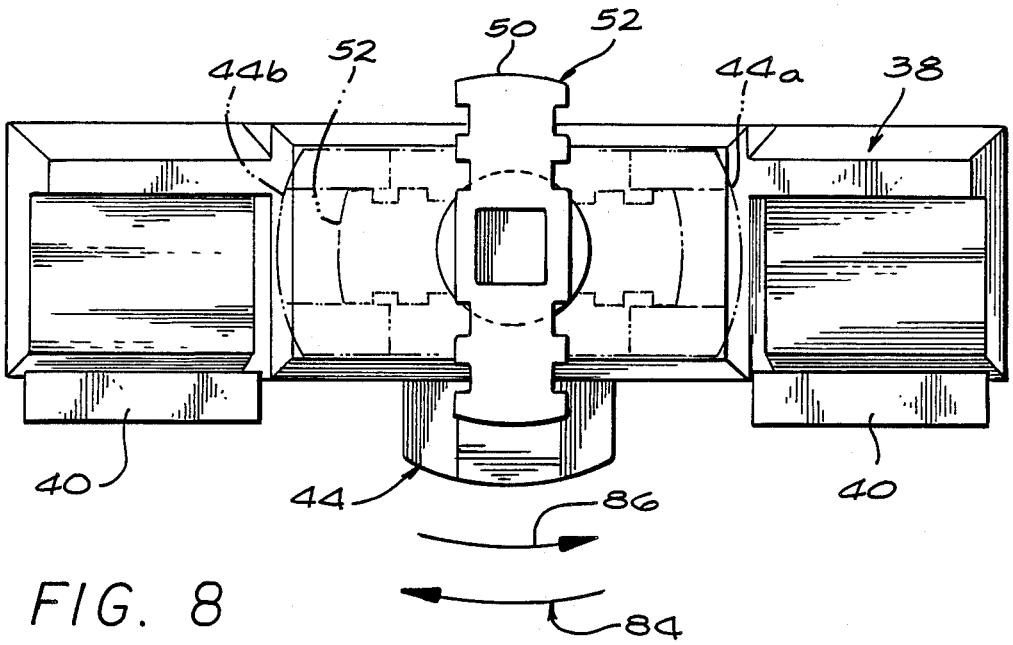
FIG. 8 is a view along the view line 8—8 of FIG. 5.
Figure 9:
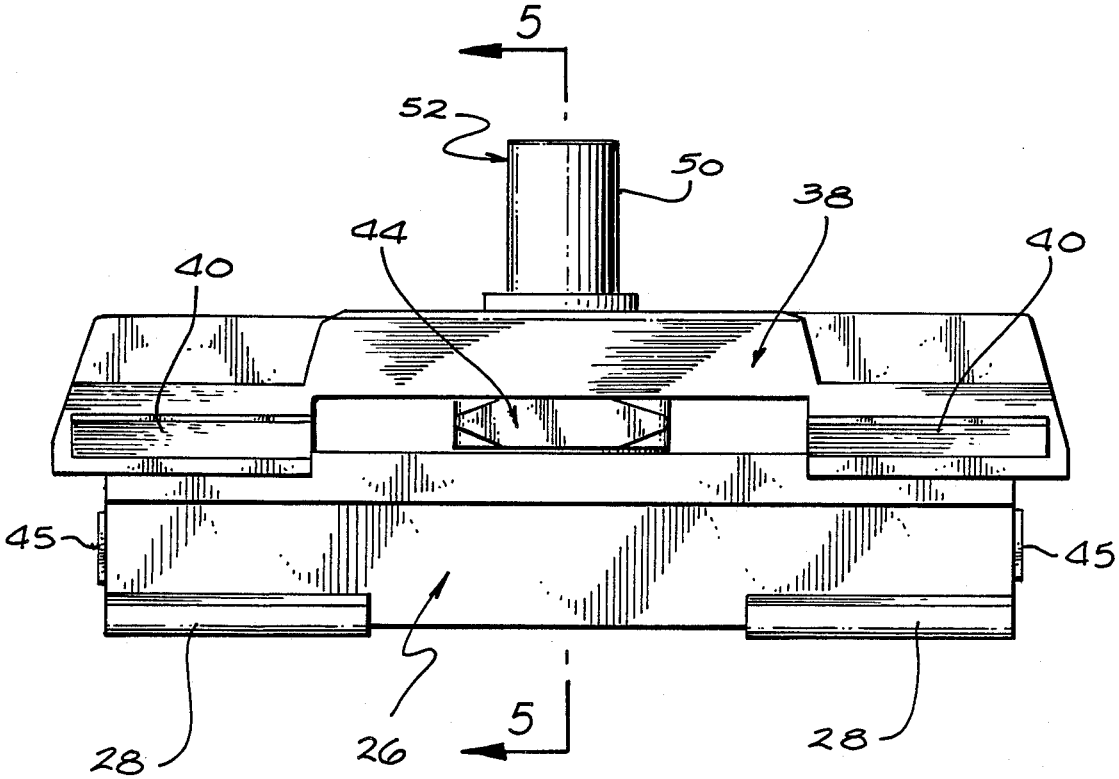
FIG. 9 is a view along the view line 9—9 of FIG. 5.

FIGS. 6, 7, 8 and 9 illustrate various views of the latch means 12 as indicated on FIG. 5. As shown in FIG. 8, the handle 52 may be rotated in both a clockwise direction as indicated by the arrow 84 and a counterclockwise direction as indicated by the arrow 86. When the handle 52 has been rotated 90° in either direction from the locked condition shown by the solid lines, the swivel cam 44 which is coupled to the handle means 52 and rotates therewith, rotates into one of the unlocked conditions indicated by the dotted line showing at 44*a* and 44*b*. For rotation of the handle means 52 in the direction indicated by the arrow 86 the swivel cam will be in the position shown by dotted lines at 44*a*. For rotation of the handle means of 50 in the direction of arrow 84 the swivel cam will be in the position indicated by the dotted lines at 44*b*. Thus, in the unlocked condition, as indicated at the dotted line showing of the handle means 52, and the swivel cam as depicted in the dotted line showing at either 44*a* and 44*b*, the swivel cam 44 is positioned within the swivel cam receiving cavity 64.

This concludes the description of the preferred embodiments of applicant's invention. Those skilled in the art may find many variations and adaptations thereof and the appended claims are intended to cover all such variations and adaptations falling within the true scope and spirit of the present invention.

What is claimed is:

1. An improved latching arrangement for selectively latching and locking together a pair of members to prevent relative movement there between in a reciprocal first direction and providing both a latched position and a locking condition as well as a latched position and unlocked condition for preventing the relative movement, and an unlatched and unlocked condition for allowing the relative movement and comprising, in combination:

a latch means having:

base means pivotally mounted on a preselected portion of a first of the pair of members adjacent a preselected portion of the second of the pair of members and pivotally movable between a latched position and an unlatched position;

first resilient means intermediate the first member and said base means for yieldingly biasing said base means towards the second member into said latched position thereof and resiliently resisting said pivotal movement of said base means away from the second member into said unlatched position;

housing means mounted on said base means for said pivotal movement therewith, said housing means having lip means extending a first preselected distance from said housing means towards the preselected portion of the second member, said housing means further having first walls defining a swivel cam receiving cavity;

a swivel cam rotatably mounted in said swivel cam receiving cavity of said housing means for rotary movement therein between a locking condition and an unlocked condition, said swivel cam extending a second preselected distance from said housing means towards the preselected portion of the second member in said locking condition thereof, and said swivel cam free of engagement with the second member in said unlocked condition thereof;

second resilient means in said housing means for selectively resiliently resisting rotary movement of said swivel cam between said locking condition and said unlocked condition thereof;

the preselected portion of the second member having first shoulder means selectively engageable with said lip means of said housing means for said base means in said latching position and said lip means free of engagement with the second member in said unlatched position; and the preselected portion of the second member further having second walls defining a channel therein for receiving said swivel cam in said locking condition thereof.

2. The arrangement defined in claim 1 and further comprising:

handle means coupled to said swivel cam for rotating said swivel cam between said locking condition and said unlocked condition thereof.

3. The arrangement defined in claim 2 wherein:

said swivel cam means further comprises:

a plurality of planar walls for engaging said second resilient means.

4. The arrangement defined in claim 3 wherein:

said plurality of planar walls comprises four planar walls in a square configuration;

said second resilient means further comprises a pair of flat leaf spring members selectively engaging portions of a first pair of said planar walls in said locking condition and portions of a second pair of said planar walls in said unlocked condition.

5. The arrangement defined in claim 1 wherein:

said second preselected distance is greater than said first preselected distance.

6. The arrangement defined in claim 2 wherein:

said handle means extends through said first walls of said housing means from a region in said swivel cam receiving cavity to a region external said housing means; and said handle means has a turn knob portion external said housing means, and a stem portion extending through said first walls of said housing means into said swivel cam receiving cavity for coupling to said swivel cam.

7. The arrangement defined in claim 1 wherein:

said base means is movable on the preselected portion of the first member in second directions substantially perpendicular to said first directions.

8. The arrangement defined in claim 7 wherein:

the preselected portion of the first member has third walls defining a tubular section portion thereof extending in said second directions; and said base means has a cylindrical portion thereof mounted in the tubular section for sliding reciprocal movement in said second directions and for said pivotal motion.

9. The arrangement defined in claim 1 or claim 8 wherein:

the preselected portion of the first member has tab means for selectively engaging said base means to limit said pivotal motion thereof towards and away from the second member.

10. The arrangement defined in claim 1 or claim 6 wherein:

said housing means is coupled to a first surface of said base means and said swivel cam receiving cavity of said housing means is adjacent said first surface; and said swivel cam is positioned in said swivel cam receiving cavity in said unlocked condition thereof.

11. The arrangement defined in claim 5 wherein:

said swivel cam is selectively positionable in said locking condition thereof for said base means in said latched position thereof.

12. The arrangement defined in claim 11 wherein:

said swivel cam means further comprises:

a plurality of planar walls for engaging said second resilient means;

said plurality of planar walls comprises four planar walls in a square configuration;

said second resilient means further comprises a pair of flat leaf spring members selectively engaging portions of a first pair of said planar walls in said locking condition and portions of a second pair of said planar walls in said unlocking condition.

13. The arrangement defined in claim 12 wherein:

said first resilient means further comprises a flat leaf spring.

14. The arrangement defined in claim 13 and further comprising:

handle means coupled to said swivel cam for rotating such swivel cam between said locking condition and said unlocked condition thereof;

said handle means extends through said first walls of said housing means from a region in said swivel cam receiving cavity to a region external said housing means; and said handle means has a turn knob portion external said housing means, and a stem portion extending through said first walls of said housing means into said swivel cam receiving cavity for coupling to said swivel cam.

15. The arrangement defined in claim 14 and further comprising:

said base means is movable on the preselected portion of the first member in second directions substantially perpendicular to said first directions;

the preselected portion of the first member has third walls defining a tubular section portion thereof extending in said second direction; and said base means has a cylindrical portion thereof mounted in the tubular section for sliding reciprocal movement in said second directions and for said pivotal motion.

16. The arrangement defined in claim 15 and further comprising:

the preselected portion of the first member has tab means for selectively engaging said base means to limit said pivotal motion thereof towards and away from said second member.

* * * * *